US007104287B1

(12) United States Patent
Schmitz

(10) Patent No.: US 7,104,287 B1
(45) Date of Patent: Sep. 12, 2006

(54) WIRE-UNTWISTING TOOL

(76) Inventor: Thomas Schmitz, 3865 Kismet Dr., Helena, MT (US) 59602

( * ) Notice: Subject to any disclaimer, the term of this patent is extended or adjusted under 35 U.S.C. 154(b) by 0 days.

(21) Appl. No.: 11/190,322

(22) Filed: Jul. 26, 2005

(51) Int. Cl.
*B21F 7/00* (2006.01)

(52) U.S. Cl. ..... 140/118; 140/117; 140/149

(58) Field of Classification Search ..... 140/117, 140/118, 119, 120, 123, 147, 149
See application file for complete search history.

(56) References Cited

U.S. PATENT DOCUMENTS

| | | | | |
|---|---|---|---|---|
| 1,453,447 | A | 5/1923 | Davidson | |
| 1,606,989 | A * | 11/1926 | Frink | 140/117 |
| 2,425,871 | A | 8/1947 | Eichorst | |
| 2,725,902 | A | 12/1955 | Giuliano | |
| 2,998,034 | A * | 8/1961 | Mann et al. | 140/123 |
| 3,168,118 | A | 2/1965 | Holman | |
| 3,312,128 | A | 4/1967 | Wasson | |
| 3,413,791 | A | 12/1968 | Feld | |
| 3,420,280 | A | 1/1969 | Allyn | |
| 3,621,890 | A | 11/1971 | Anderson | |
| 3,670,784 | A | 6/1972 | Ackerman | |
| 3,759,302 | A | 9/1973 | Attenborough | |
| 3,875,601 | A | 4/1975 | Kaufman | |
| 3,884,276 | A * | 5/1975 | Poplaski | 140/115 |
| 3,957,092 | A * | 5/1976 | Loy et al. | 140/115 |
| 4,064,581 | A | 12/1977 | Kober | |
| 4,188,840 | A | 2/1980 | Martschinke | |
| 4,444,228 | A | 4/1984 | Demirjian | |
| 4,620,573 | A | 11/1986 | Meder | |
| 5,004,020 | A | 4/1991 | Meinershagen | |
| 5,379,809 | A * | 1/1995 | Waulk | 140/118 |
| 5,595,219 | A | 1/1997 | Deuel | |
| 5,853,033 | A | 12/1998 | Kavanagh | |
| 5,957,685 | A | 9/1999 | Kanno | |
| 6,668,870 | B1 | 12/2003 | Rossum | |

* cited by examiner

*Primary Examiner*—Derris H. Banks
*Assistant Examiner*—Teresa M Bonk
(74) *Attorney, Agent, or Firm*—Andrew McAleavey

(57) ABSTRACT

Wire-untwisting tools and tool bits are disclosed. The wire-untwisting tool comprises a tool body, a movable member, and a spring. The tool body has a first channel extending inwardly from a first surface and a second channel extending inwardly from a second surface. The movable member includes a third channel, and is positioned within the second channel to move therein between an open position, in which the first and third channels are substantially aligned and contiguous, and a gripping position, in which they are not. The spring bears between the tool body and the movable member so and biases the movable member toward the gripping position. A pair of twisted wires inserted into the aligned channels of the tool body and the movable member when the movable member is pushed into the open position will be gripped for untwisting when the movable member moves back to the gripping position.

18 Claims, 5 Drawing Sheets

WIRE-UNTWISTING TOOL

BACKGROUND OF THE INVENTION

1. Field of the Invention

The invention relates generally to the field of wirework, and more specifically, to tools for untwisting wires.

2. Description of Related Art

Pairs of metal wires are often twisted together into a helical configuration. This sort of twisting can be used to join wires over long lengths, and has certain other uses and advantages. For example, when wires are used to carry electrical signals, helical twisting of pairs of wires reduces electromagnetic interference with the signals that the two wires are carrying.

Cables using metal wires for signal conduction are in wide and common use. One of the more common cables in use today is the standard Category-5 (CAT-5) Ethernet cable, which is used to connect computers and other computing hardware for networking purposes. Inside the CAT-5 Ethernet cable are four twisted pairs of wires, for a total of eight conductor wires. The ends of the cable may be capped with standard RJ-45 connectors, or the wires may simply be connected to appropriate terminal blocks without a connector, depending on the application.

When installing or otherwise manipulating cables that use twisted pair wires, it is often necessary to untwist the individual wires so that they can be fitted into connectors or terminal blocks. For example, to insert the end of the CAT-5 Ethernet cable into a connector, the four pairs of wires are untwisted a short distance, and the connector is crimped over the untwisted, straightened ends. An electrical connection is made by contacts within the connector that penetrate the insulation of the individual wires.

Ethernet cable is often installed in large volumes, for example, in a new office building. A large spool of the cable is usually brought in, and installers are left to cut whatever lengths of cable are necessary from the spool. In order to connect those pieces of cable, a short length of the twisted pairs of wires is untwisted, as was described above. The process of untwisting the pairs of wires during the installation can be laborious and difficult, and becomes more so as the user repeats the operation many times to make multiple cables. The installer may have difficulty grasping the wires, and after a number of such operations, his or her fingers may hurt.

SUMMARY OF THE INVENTION

One aspect of the invention relates to a wire-untwisting tool. The wire-untwisting tool comprises a tool body, a movable member, and a spring. The tool body has a first channel extending inwardly from a first surface and a second channel extending inwardly from a second surface. The movable member includes a third channel, and is adapted to be inserted into the second channel in the tool body and to move therein between an open position, in which the first and third channels are substantially aligned and contiguous, and a gripping position, in which the first and third channels are misaligned. The spring is arranged to bear between the tool body and the movable member so as to bias the movable member toward the gripping position. A pair of twisted wires inserted into the substantially aligned first and third channels when the movable member is in the open position will be gripped by the misaligned first and third channels when the movable member is in the gripping position.

Another aspect of the invention relates to a wire-untwisting tool. The wire untwisting tool comprises an elongate tool body with an end face, a movable member, and a spring. A first channel is formed in the tool body so as to extend inwardly from and generally perpendicular to the end face. A second channel is formed in the tool body proximate and generally parallel to the end face. The movable member has a third channel formed therein and is positioned within the second channel of the tool body for sliding movement in a direction generally parallel to the end face between an open position in which the first channel is aligned and contiguous with the third channel and a gripping position in which the first and third channels are misaligned. The spring is arranged to bear between the movable member and the tool body so as to bias the movable member toward the gripping position.

Yet another aspect of the invention relates to a wire-untwisting tool bit. The wire-untwisting tool bit comprises a wire-gripping and untwisting portion and a shank portion. The shank portion is constructed and arranged to be inserted into a handle or gripping device. The wire gripping and untwisting portion includes an end face. A first channel is formed in and extends inwardly from the end face. A second channel is formed in and extends inwardly from a second surface. A movable member has a third channel formed therein and is positioned within the second channel for sliding movement in a direction generally parallel to the end face between an open position in which the first channel is aligned and contiguous with the third channel and a gripping position in which the first and third channels are misaligned. A spring is arranged to bear between the movable member and the tool body so as to bias the movable member toward the gripping position.

Other aspects, features, and advantages of the invention will become apparent from the description that follows.

BRIEF DESCRIPTION OF THE DRAWINGS

The invention will be described with respect to the following drawing figures, in which like numerals represent like structures throughout the figures, and in which.

DETAILED DESCRIPTION

Figure 1:
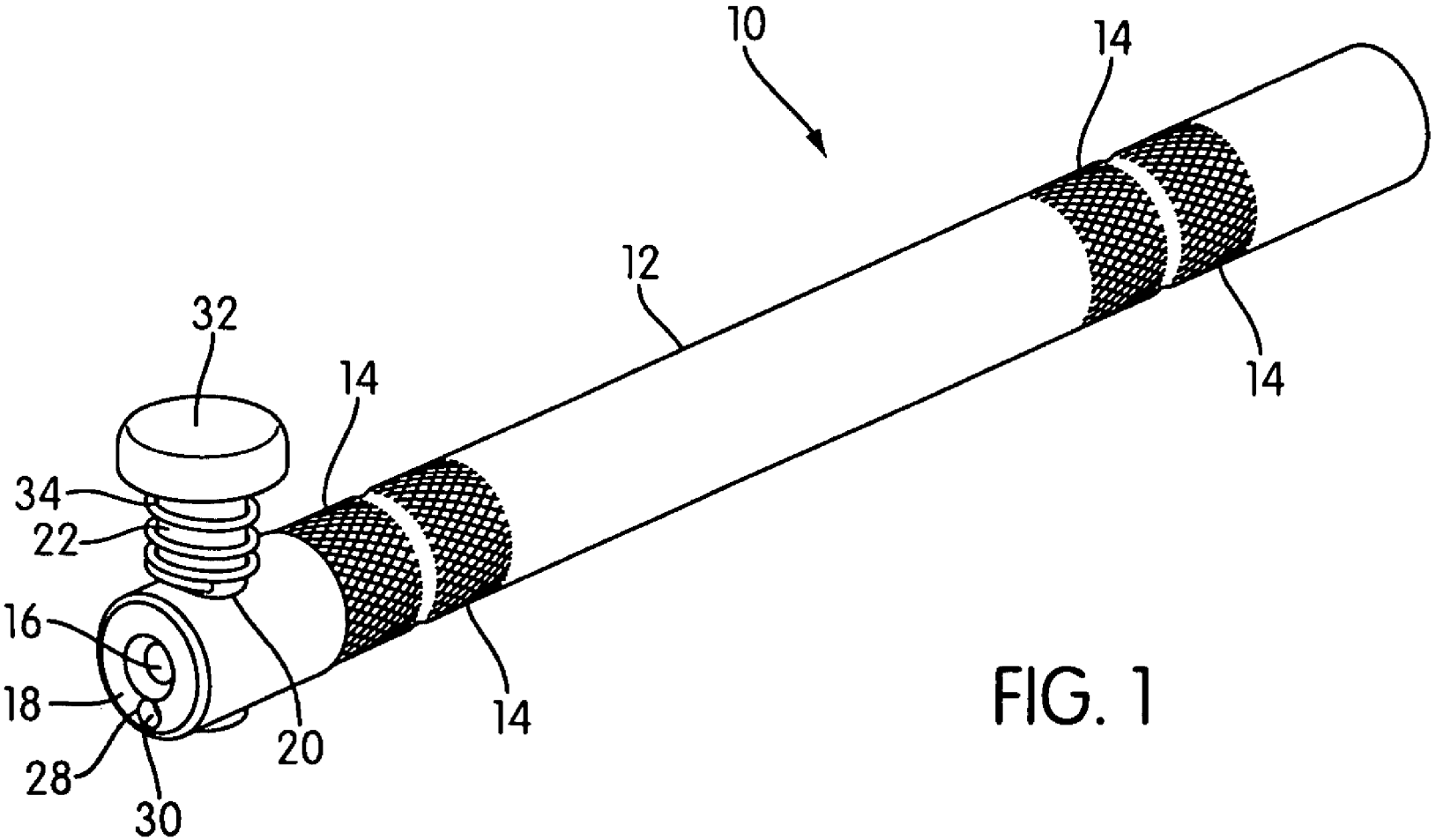
FIG. 1 is a perspective view of a wire-untwisting tool according to one embodiment of the invention.

FIG. 1 is a perspective view of a wire-untwisting tool, generally indicated at 10, according to one embodiment of the invention. The wire-untwisting tool 10 of the illustrated embodiment includes an elongate tool body 12 that is generally cylindrical and is sized to fit comfortably in the hand of a user. The tool body 12 includes knurled portions 14 to make it easier to grip and hold. In addition to the knurled portions, the tool body 12 may have any shape or any features that make it easier to grip and hold.

Figure 2:
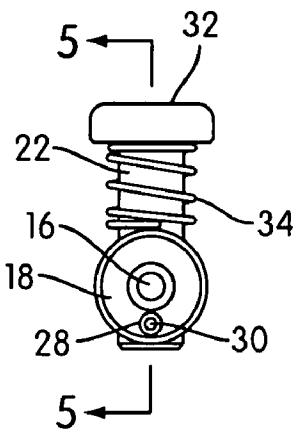
FIG. 2 is a front elevational view of the wire-untwisting tool of FIG. 1.

FIG. 2 is a front elevational view of the tool 10. As shown in FIGS. 1 and 2, at one end of the tool body 12, a first channel 16 is bored into an end face 18. In the illustrated embodiment, the channel is countersunk, i.e., the end of the first channel 16 that joins the end face 16 is enlarged and beveled. The first channel 16 is of sufficient size to admit a twisted pair of wires. (The use of the first channel 16 and the tool 10 will be described in more detail below.) In the illustrated embodiment, the first channel 16 is round and of generally constant diameter inwardly of the countersunk portion, although this need not be the case in all embodiments.

Figure 3:
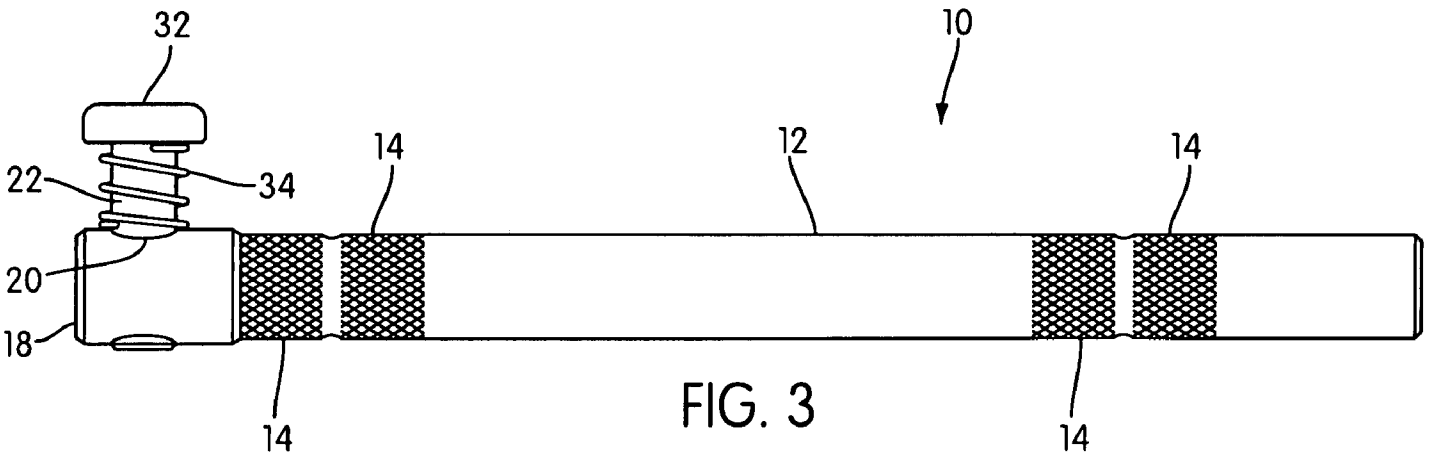
FIG. 3 is a side elevational view of the wire-untwisting tool of FIG. 1.
Figure 4:
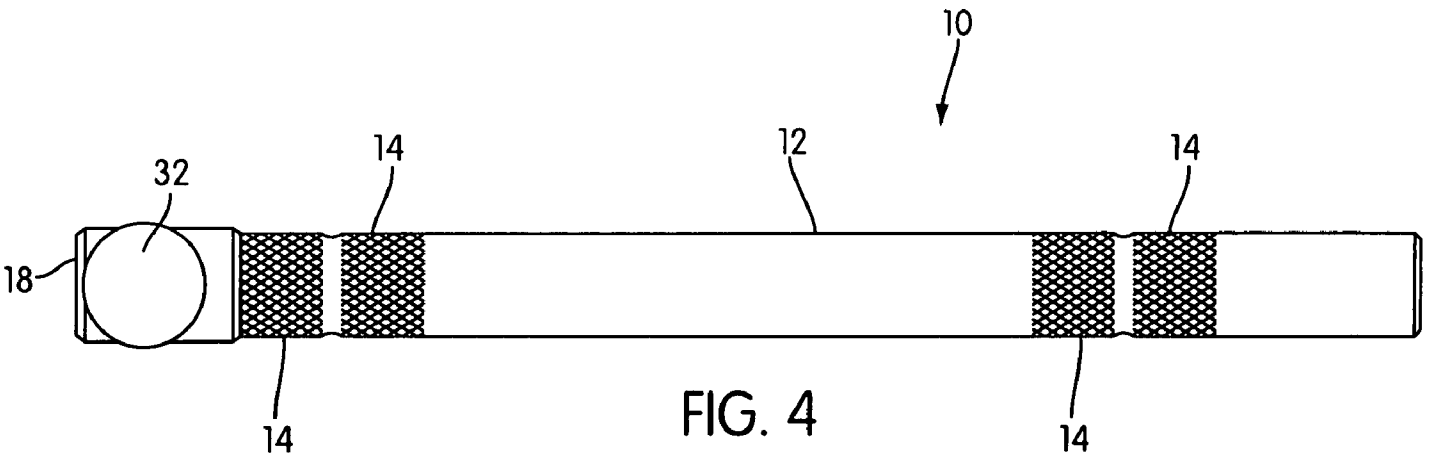
FIG. 4 is a top plan view of the wire-untwisting tool of FIG. 1.
Figure 5:
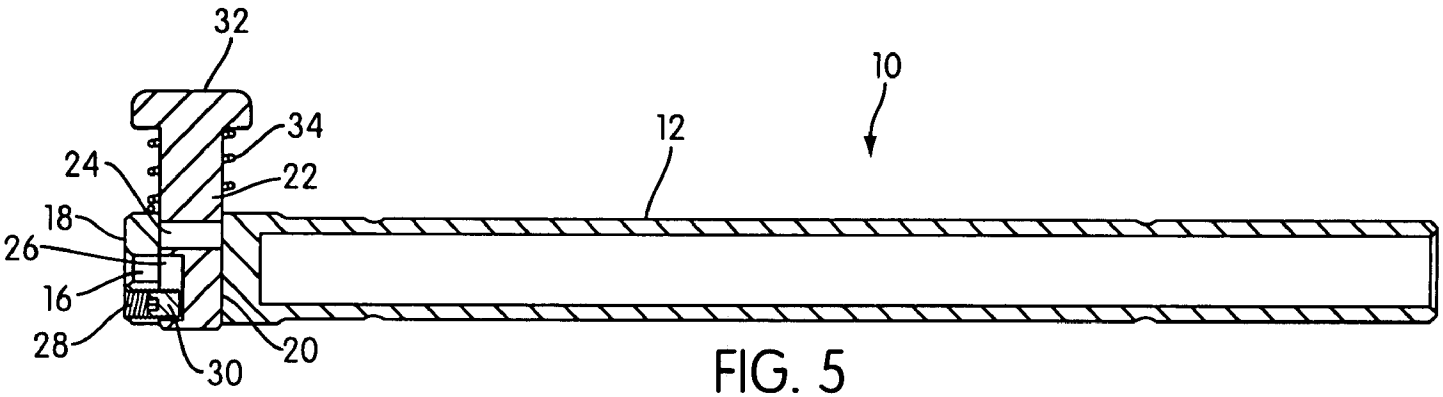
FIG. 5 is a sectional view of the wire-untwisting tool of FIG. 1 taken through Line 5—5 of FIG. 2.

FIGS. 3 and 4 are side elevational and top plan views, respectively, of the tool 10, and FIG. 5 is a sectional view of the tool 10, taken through Line 5—5 of FIG. 2. As is shown particularly in FIGS. 1, 3, and 5, a second channel 20 of greater diameter is formed in the side surface of the tool body 12 proximate to the end face 18 and extends through the tool body 12 parallel to the end face 18.

A movable member 22 in the form of a plunger is inserted into the second channel 20 and is constructed and arranged to move within the second channel 20. The movable member 22 has a channel 24 formed within it. The channel 24 of the movable member 22 extends parallel to the first channel 16 in the end face 18 of the tool body 12 and has generally the same diameter as the first channel 16.

The movable member 22 is adapted to move between an open position, in which the first channel 16 is substantially aligned with the channel 24 of the movable member 24 and a gripping position, in which the channel 24 of the movable member 22 is not aligned with the first channel 16. (In the position depicted in FIGS. 1–5, the channel 24 of the movable member 22 is not aligned with the first channel 16.)

In order to constrain the motion of the movable member 22 and retain it within the second channel 20 in the tool body, a recessed portion 26, visible in the sectional view of FIG. 5, is formed in the movable member 22, in this case, just below the channel 24 in the movable member 22. Below the first channel 16 in the end face 18 of the tool body 12, a threaded hole 28 is formed and extends inwardly, opening into the second channel 20 of the tool body 12. A set screw 30 is inserted into the threaded hole 28 and extends into the recessed portion 26 of the movable member 22, thus constraining the movement of the movable member 22 and preventing it from rotating. The end of the set screw 30 that contacts the recessed portion 26 may be made of plastic or another material that will perform the function without undue wear on the recessed portion 26. The head of the set screw 30 is typically adapted to engage an Allen (hex) key or another type of fastener driver.

Although illustrated as being on the end face 18 of the tool body 12 in this embodiment, the set screw 30 and corresponding recessed portion 26 in the movable member 22 could be in any position. For example, they could be on the side of the tool body 12, away from the opening of the first channel 16. Additionally, other mechanisms for constraining the movement of the movable member may be used in other embodiments. For example, the movable member could be keyed (i.e., given a protrusion of a specific shape) and then used with a channel in the tool body of a corresponding and interengaging shape in order to prevent rotation. An enlarged bottom end, like that of a rivet, would prevent the movable member from leaving the tool body.

The top end of the movable member 22 has an enlarged pressure application portion 32 that is sized and shaped to be depressed by a user's thumb. A coil-type compression spring 34 bears between the underside of the pressure application portion 32 and the tool body 12, biasing the movable member into an upward, gripping position.

Figure 6:
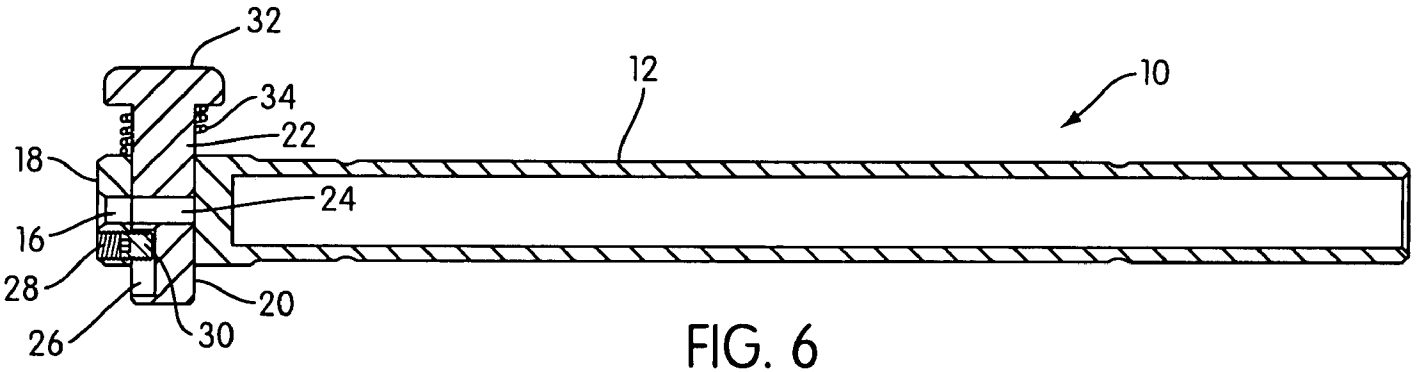
FIG. 6 is a sectional view of the wire-untwisting tool similar to the view of FIG. 5, showing the movable member of the tool in the open position.
Figure 7:
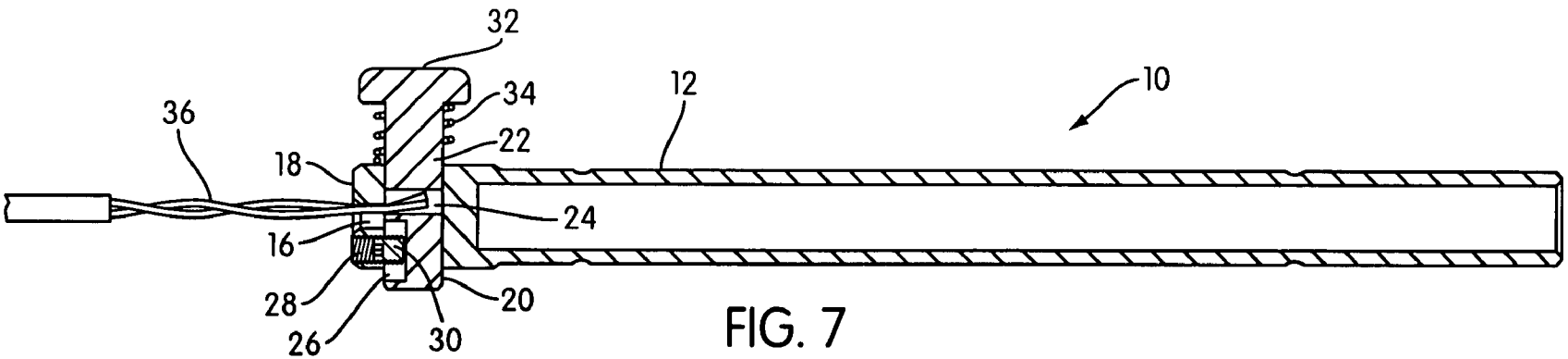
FIG. 7 is a sectional view of the wire-untwisting tool similar to the view of FIG. 6 showing the tool gripping a pair of twisted wires with the movable member in the gripping position.

The use of the tool 10 and the other positions of the movable member 22 are shown with more particularity in FIGS. 6 and 7, which are sectional views of the tool similar to the view of FIG. 5 with the movable member in an open and a gripping position, respectively. Specifically, in the position of FIG. 6, the pressure application portion 32 of the movable member 22 has been depressed, causing the spring 34 to compress and the movable member 22 to move downwardly into a position in which the first channel 16 formed in the end face 18 of the tool 10 is aligned and contiguous with the channel 24 in the movable member 22. In that position, the set screw 30 has also contacted the upward end of the recess 26; therefore, the movable member 22 cannot be moved downwardly any farther.

With the movable member 22 in the position illustrated in FIG. 6, the user can insert a twisted pair of wires 36 into the aligned and contiguous channels 16, 24 while holding the movable member 22 in the illustrated position. When the movable member 22 is released, the spring 34 will move it upwardly, until the movable member 22 is in the gripping position shown in FIG. 7. As shown in FIG. 7, with the first channel 16 and the channel 24 of the movable member 22 misaligned, the pair of wires 36 is caught and gripped between the top of the first channel 16 and the bottom of the channel 24 of the movable member 22.

Once the wires 36 are gripped by the tool 10 as shown in FIG. 7, the user is free to rotate the tool 10 clockwise or counterclockwise as much as necessary to untwist the two wires 36. Once a sufficient length of the wires 36 is untwisted, the user again depresses the pressure application portion 32 to move the movable member 22 into the open position illustrated in FIG. 6, this releasing the untwisted wires.

The two channels 16, 24 and the tool 10 as a whole may be sized for any size or diameter of wires. Additionally, the two channels 16, 24 may have different sizes or lengths. For example, the channel 24 of the movable member 22 may be made slightly larger in diameter than the first channel 16 so as to prevent wires from being caught between the two channels 16, 24 if a misalignment occurs in the open position of the movable member 22.

The channel 24 of the movable member 22 may also be bored through only a portion of the movable member 22, instead of being bored through its entire thickness. There may be certain advantages to doing so. Specifically, it is generally desirable to grip the shortest possible length of wire in most untwisting applications. If a relatively long length of wire is inserted into the two channels, 16, 24, the clamped end of the wire may remain twisted, even though the rest of the wire is untwisted. However, if the length of the channel 24 in the movable member 22 is shorter, it is less likely that the clamped end of the wire will remain twisted. The length of the channel 24 in the movable member 22 may also be modified by inserting a plug of appropriate dimensions.

The amount of force necessary to successfully grip the wires for untwisting may increase as the size of the wire increases. In general, the properties of the spring 34 and the amount of force imparted by it may vary from embodiment to embodiment, but the spring force should be sufficient to retain the wires without unduly fatiguing the user. Moreover, if the wires to be untwisted are relatively small in diameter, it may be advantageous to use a relatively weak spring, so that the gripping action does not accidentally sever the wires.

The tool 10 can be made using a number of fabrication processes and a number of materials. Metal is believed to be the most durable of the materials from which tool 10 may be made. However, the tool 10 may also be made out of a plastic or composite material, if desired. In many applications, the wires that are to be untwisted will be electrically insulated, and thus, there will be little or no concern about the possibility of an electrical short. If the wires are uninsulated or there is concern about the possibility of an electrical short, the tool 10 could be made of a nonconductive material, such as plastic, or the channels 16, 24 could be lined with such a material.

The fabrication process will depend on the material of which the tool 10 is made, although, in general, the parts may be molded, cast, or machined, depending on the material. As one example, a steel rod 5.25 inches in length and 0.450 inches in diameter was used to make a tool 10. Appropriate holes were drilled and countersunk in the end face for the first channel 16 and drilled and tapped for the set screw hole 28. The diameter of the first channel 16 was 0.113 inches, drilled with a No. 33 drill bit. The set screw hole was drilled with a No. 43 drill bit (0.089 inches) and tapped for a 4-40 set screw. The diameter of the second channel 20 was 0.250 inches. The movable member 22 was 0.940 inches in overall length, with a recessed portion 0.400 inches in length. The resulting tool was found to work well for untwisting the conductors of Ethernet cables, including CAT-5 cables. The resulting tool should also work well with other twisted pair cables, including CAT-3 and CAT-3A Ethernet cables.

In order to reduce the weight of the tool 10, the majority of the tool body 12 may be bored out or otherwise formed without a solid central portion, as is shown in FIGS. 5–7. This may be particularly useful if the tool 10 is made of metal.

Other adaptations and changes to the tool 10 may be made without altering its basic function and manner of operation. For example, in the tool 10 of FIGS. 1–7, the movable member 22 translates vertically, biased by a compression spring 34. In other embodiments, the spring could be a torsional spring, and the movable member could rotate, rather than translating, to move into a gripping position. In that case, the user would twist the top of the movable member to move it. Certain changes would be made for a torsional spring embodiment; for example, the recess that constrains the movement of the movable member would be cut circumferentially, instead of longitudinally.

Additionally, features may be added to the tool body 12 to facilitate handling. For example, a pocket clip, similar to those used with pens, could be added to the tool body 12, as could a clip, ring, or other structure to engage a tool belt.

In the embodiment illustrated in FIGS. 1–7, the tool 10 includes an elongate tool body 12 that is suitable for use as a handle. However, in other embodiments, the functional features and components of the tool 10 could be made in the form of a tool bit, to be inserted into any one of a number of standard handles.

Figure 8:
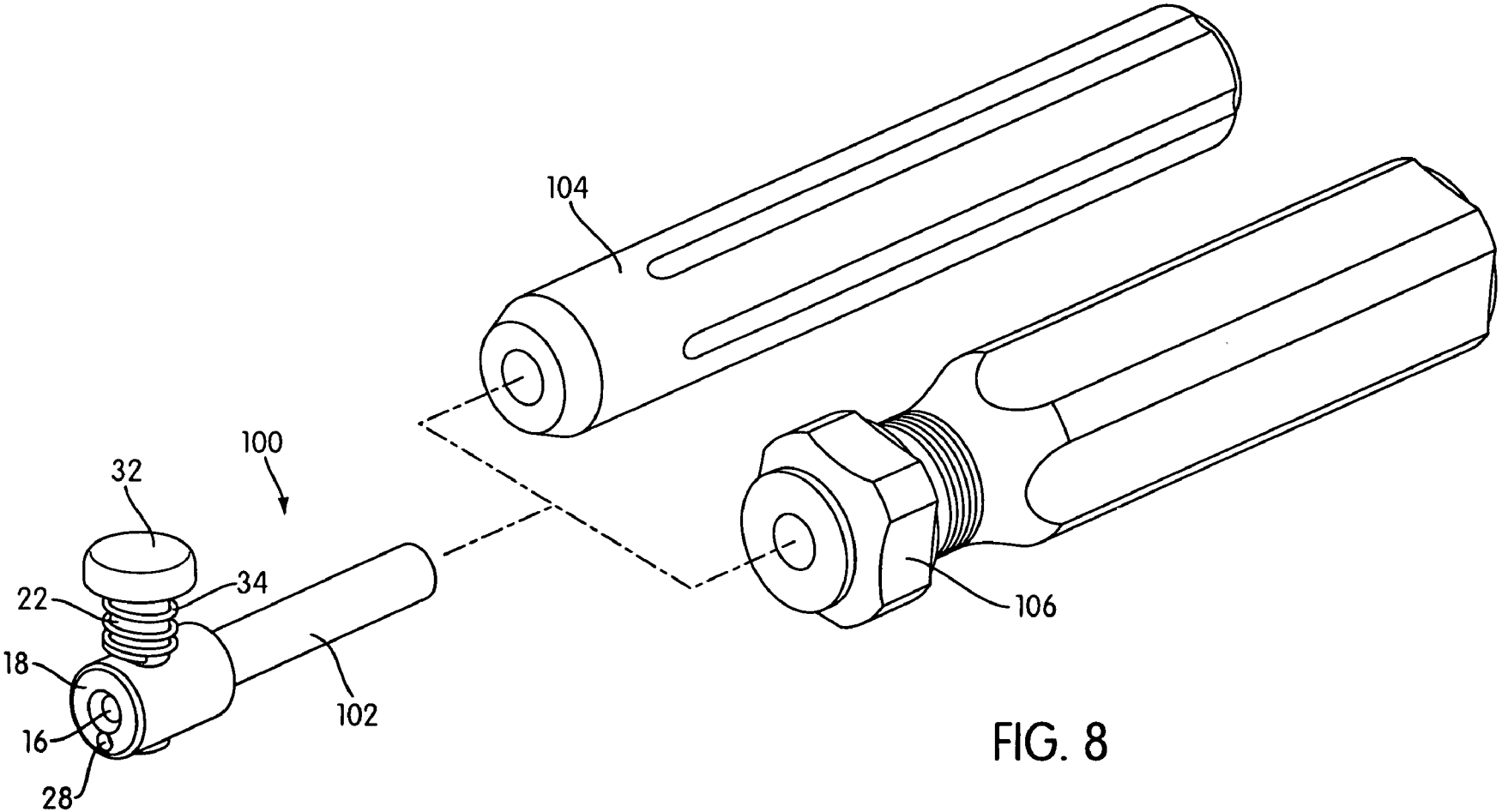
FIG. 8 is a perspective view of a wire-untwisting tool bit according to another embodiment of the invention.

FIG. 8 is a perspective view of a wire-untwisting tool bit 100 according to another embodiment of the invention. The tool bit 100 has the same functional, wire-untwisting components as the tool 10; therefore, the description above will suffice for those components. However, instead of a tool body 12 that is suitable for use as a handle, the tool bit 100 includes a round shank 102 that is sized and shaped for insertion into a variety of standard handles 104, 106 and chucks. If the tool bit 100 is inserted into a handle 104, 106, it may be held in place with a set screw or any other compatible mechanism.

In some embodiments, the tool bit 100 could be inserted into the chuck of, for example, a power drill, and used with the power drill. However, for most wire untwisting jobs, the use of a power tool may be excessive, because the wire would likely untwist and then begin re-twisting before the user could stop the power tool. Of course, there may be some applications in which use with a power tool has advantages, for example, if a particularly long length of wire is to be untwisted.

Even without a power tool, the tool bit 100 has advantages. One advantage is that the user can pick whichever handle feels most comfortable in his or her hand. Users who are arthritic, for example, may pick a larger or more easily gripped handle. Another advantage is that if a user has multiple tools that fit a standard handle 104, 106, the overall weight and number of tools that the user carries can be reduced.

Figure 9:
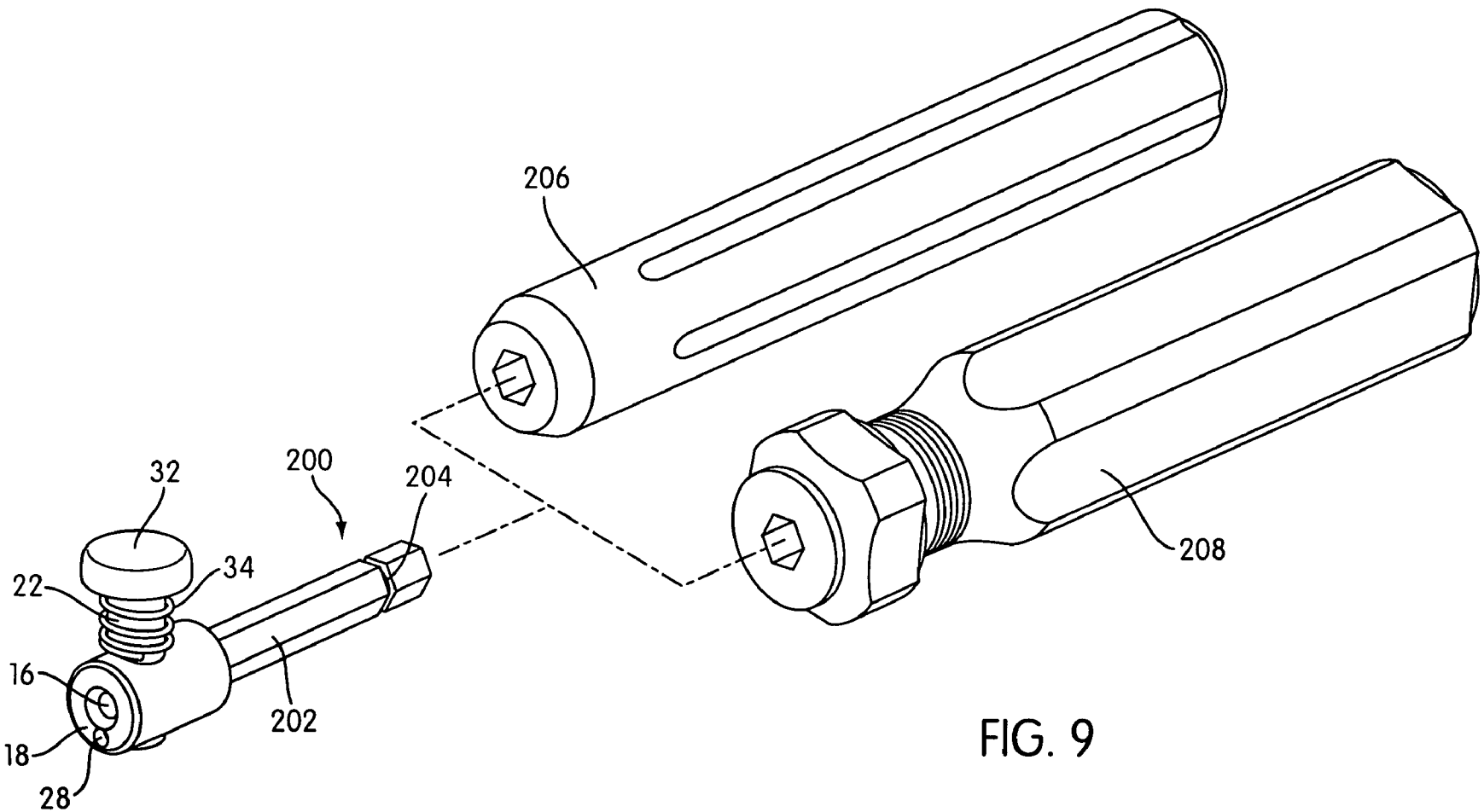
FIG. 9 is a perspective view of a wire-untwisting tool bit according to yet another embodiment of the invention.

While a round tool bit 100 may be convenient for some applications and some handles 104, 106, it is by no means the only shape in which a wire untwisting tool bit may be made. FIG. 9 is a perspective view of a tool bit 200 according to yet another embodiment of the invention.

The tool bit 200 has the same functional, wire-untwisting components as the other embodiments of the tool 10 and the tool bit 100. However, the shank 202 of the tool bit 200 has a hexagonal shape, and is particularly of the type that includes a circumferential channel 204 in a rearward portion. The circumferential channel 204 helps the standard hex-bit handles 206, 208 to grip the shank 202.

Most tool bits that are used with standard handles rely, at least in part, on compressive forces on the tool bit during use to retain the tool bit within the handle. Some handles use a relatively weak retaining mechanism, such as a magnet, to keep the tool bit within the handle at other times. However, as the wire-untwisting tools and tool bits 10, 100, 200 are used to untwist wire, some axial tension may be placed on the tool 10 or tool bit 100, 200. Therefore, it is advantageous if the engagement of the tool bit 100, 200 with the handle 104, 106, 206, 208 is by a mechanism that is able to resist at least some axial tension without allowing the tool bit 100, 200 to slip out of the handle 206, 208. In the case of the tool bit 200, the circumferential channel 204, in cooperation with structure inside the handles 206, 208 performs this function.

Other shapes for wire untwisting tool bits according to embodiments of the invention may also be used. Shapes that prevent rotation of the tool bit within the handle are particularly advantageous.

Additionally, although the tool bits 100, 200 were described above as being interchangeable by the user, a tool bit 100, 200 could be press-fit by a manufacturer into a particular handle so that it is not removable by the user. This is one way in which a manufacturer might make a number of wire-untwisting tools with different types of handles.

While the invention has been described with respect to certain exemplary embodiments, the description is meant to be illuminating, rather than limiting. Certain modifications and changes may be made without departing from the scope of the invention, which is defined by the claims.

What is claimed is:

1. A wire-untwisting tool, comprising:

a tool body having a first channel extending inwardly from a first surface and a second channel extending inwardly from a second surface, the first and second channels extending along distinct, substantially perpendicular planes such that the first and second channels meet and open to one another at a substantially perpendicular intersection;

a movable member including a third channel, the movable member being adapted to be inserted into the second channel in the tool body and to move therein between an open position, in which the first and third channels are substantially aligned and contiguous, and a gripping position, in which the first and third channels are misaligned; and a spring arranged to bear between the tool body and the movable member so as to bias the movable member toward the gripping position;

wherein a pair of twisted wires inserted into the substantially aligned first and third channels when the movable member is in the open position will be gripped by the misaligned first and third channels when the movable member is in the gripping position.

2. The wire-untwisting tool of claim 1, wherein:

the movable member further comprises an enlarged pressure application portion on an end thereof and the spring bears between an underside of the pressure application portion and the tool body.

3. The wire-untwisting tool of claim 1, wherein the tool body is elongate and the first channel is formed so as to extend inwardly from an outer end face of the tool body.

4. The wire-untwisting tool of claim 1, wherein the movable member and the tool body include complimentary engaging features adapted to retain the movable member within the second channel.

5. The wire-untwisting tool of claim 4, wherein the complimentary engaging feature of the movable member is a recess formed in a surface thereof and the complimentary engaging feature of the tool body is a hole formed in a portion thereof, such that an elongate member inserted through the hole will rest at least partially in the recess.

6. The wire-untwisting tool of claim 5, wherein the elongate member is a set screw in threaded engagement with the hole.

7. The wire-untwisting tool of claim 1, further comprising a handle, wherein the tool body is constructed and arranged to engage the handle.

8. The wire-untwisting tool of claim 1, wherein the tool body defines a handle portion.

9. The wire-untwisting tool of claim 8, wherein the first and second channels are located proximate to one another at one end of the tool body.

10. A wire-untwisting tool, comprising:

an elongate tool body with an end face;

a first channel formed in the tool body so as to extend inwardly from and generally perpendicular to the end face;

a second channel formed in the tool body proximate and generally parallel to the end face, the first and second channels having lengths sufficient to intersect and open to one another at a generally perpendicular intersection;

a movable member having a third channel formed therein, a substantial portion of the movable member positioned within the second channel of the tool body for sliding movement in a direction generally parallel to the end face between an open position in which the first channel is aligned and contiguous with the third channel and a gripping position in which the first and third channels are misaligned, the movable member also having a recess therein, the recess receiving an elongate member from the tool body to retain the tool body and the movable member in engagement as the movable member moves between the open and gripping positions; and a spring arranged to bear between the movable member and the tool body so as to bias the movable member toward the gripping position.

11. The wire-untwisting tool of claim 10, wherein a pair of twisted wires inserted into the aligned first and third channels when the movable member is in the open position will be gripped by the wire-untwisting tool when the movable member is in the gripping position, and a rotation of the tool body about a rotational axis perpendicular to the end face will cause the pair of twisted wires to be untwisted.

12. The wire-untwisting tool of claim 10, wherein the tool body defines a handle.

13. The wire-untwisting tool of claim 10, wherein the tool body is constructed and arranged to be inserted into a handle.

14. A wire-untwisting tool bit, comprising:

a wire-gripping and untwisting portion, including:

an end face, a first channel formed in and extending inwardly from the end face, a second channel formed in and extending inwardly from a second surface, the first and second channels extending along distinct, substantially perpendicular planes such that the first and second channels meet and open to one another at a substantially perpendicular intersection, a movable member having a third channel formed therein, a substantial portion of the movable member positioned within the second channel for sliding movement in a direction generally parallel to the end face between an open position in which the first channel is aligned and contiguous with the third channel and a gripping position in which the first and third channels are misaligned, and a spring arranged to bear between the movable member and the tool body so as to bias the movable member toward the gripping position; and a shank portion constructed and arranged to be inserted into a handle or gripping device.

15. The wire-untwisting tool bit of claim 14, wherein the shank portion is round.

16. The wire-untwisting tool bit of claim 14, wherein the shank portion is hexagonal.

17. The wire-untwisting tool of claim 10, wherein the tool body includes a threaded hole, and the elongate member received in the recess of the movable member is a set screw in threaded engagement with the hole of the tool body.

18. The wire-untwisting tool of claim 17, wherein the elongate member, in engagement with the recess and the hole, essentially prevents the movable member from moving past the open and the gripping positions.

* * * * *